US005528780A

United States Patent [19]

Taylor

[11] Patent Number: 5,528,780

[45] Date of Patent: Jun. 25, 1996

[54] MATTRESS PAD WITH FRICTIONAL HOLDING MEANS

[76] Inventor: Martha K. Taylor, 667 Paxson Ave., Mercerville, N.J. 08619-1140

[21] Appl. No.: 367,743

[22] Filed: Jan. 3, 1995

[51] Int. Cl.[6] ..... A47G 9/04

[52] U.S. Cl. ..... 5/499; 5/925; 5/496

[58] Field of Search ..... 5/925, 982, 499, 5/500, 502, 495, 496, 498

[56] References Cited

U.S. PATENT DOCUMENTS

| | | | |
|---|---|---|---|
| 2,639,444 | 5/1953 | De Monsabert | 5/499 |
| 3,113,326 | 12/1963 | Hyde et al. | 5/500 |
| 3,205,514 | 9/1965 | Reynolds | 5/925 |
| 4,646,375 | 3/1987 | Parker | 5/496 |
| 4,980,941 | 1/1991 | Johnson, IV | 5/499 |
| 5,127,115 | 7/1992 | Williams et al. | 5/497 |
| 5,201,086 | 4/1993 | Decker | 5/925 |
| 5,249,322 | 10/1993 | Seago | 5/499 |

*Primary Examiner*—Alexander Grosz

[57] ABSTRACT

A fitted mattress pad has a flat top portion with a skirt portion depending from its sides and edges. At least part of the skirt portion has frictional holding means for holding the mattress pad securely in place over a mattress. The frictional holding means help to grip the mattress and keep the mattress pad from shifting during use.

4 Claims, 1 Drawing Sheet

MATTRESS PAD WITH FRICTIONAL HOLDING MEANS

FIELD OF THE INVENTION

This invention relates to a fitted mattress pad with frictional holding means for holding the mattress pad and additional bedding securely on a mattress.

BACKGROUND OF THE INVENTION

It is known to use mattress pads, or mattress covers, for maintaining mattresses in clean condition and for providing extra padding between the mattress and the bottom sheet on a bed. Mattress pads generally have, at the very least, a flat top portion of quilted fabric or water-proof material for overlying the top surface of the mattress. Many mattress pads also have some means for holding the top portion in place on the mattress.

Some mattress pads have elastic bands attached diagonally across their corners to hold them in place. In use, these elastic bands pass around and under the corners of the mattress to keep the top portion of the mattress pad spread neatly over the top of the mattress. Frequently, however, the elastic bands become detached from the top portion of the mattress pad, or they tend to slip off the mattress corners. When either of these occur, the mattress pad is no longer held securely on the mattress, and it may slide or become bunched under the bottom sheet.

More typically, a mattress pad consists of a flat top portion with a skirt portion hanging from its sides. The bottom edge of the skirt portion is usually elasticized. In use, the skirt portion fits around the sides and tucks under the bottom edges of the mattress to help hold the top portion of the mattress pad in place on the mattress' top surface. Generally, this type of mattress pad remains in place on the mattress as long as it is sized to fit the mattress. Recently, however, mattress manufacturers have begun making mattresses of varying sizes, and standard size mattress pads do not always fit these non-standard mattresses. A common problem with these mattress pads is that they slip off the mattresses easily. In fact, the normal movements of a person sleeping on the mattress often cause the mattress pad and any overlying bedding to slide off at least one corner of the mattress. This problem is exacerbated when the mattress itself is covered with a smooth or satiny fabric.

The problem of fitting standard size mattress pads securely onto non-standard size mattresses applies to other bedding as well. Like mattress pads, fitted sheets are generally made to fit standard size mattresses. Therefore, the new variability in mattress sizes creates a further problem with the fitted sheet: even if the mattress pad stays in place, the fitted sheet often is not the correct size, and it may either slip off one corner of the mattress or slide off the mattress entirely.

It is an object of the present invention to provide a mattress pad which remains securely fitted onto a standard or non-standard size mattress even during moderate movement by a person sleeping on the mattress.

It is another object of the present invention to provide a mattress pad which remains securely fitted onto a mattress with a smooth or satiny covering.

It is a further object of the present invention to provide a mattress pad which helps to hold a bottom sheet securely fitted onto a mattress.

SUMMARY OF THE INVENTION

The present invention provides a fitted mattress pad consisting of a flat top portion with a skirt portion depending from its sides and edges, wherein at least part of the skirt portion has frictional means for holding the mattress pad securely in place over the mattress. The frictional means face toward the mattress when the mattress pad is in place, and the frictional means prevent the mattress pad from sliding relative to the mattress. In another embodiment of the mattress pad, the skirt portion has additional frictional means which face outwardly from the mattress. These outwardly-facing frictional means help to grip a fitted or bottom sheet overlying the mattress pad and keep it securely in place over the mattress pad.

DETAILED DESCRIPTION OF THE INVENTION

Figure 1:
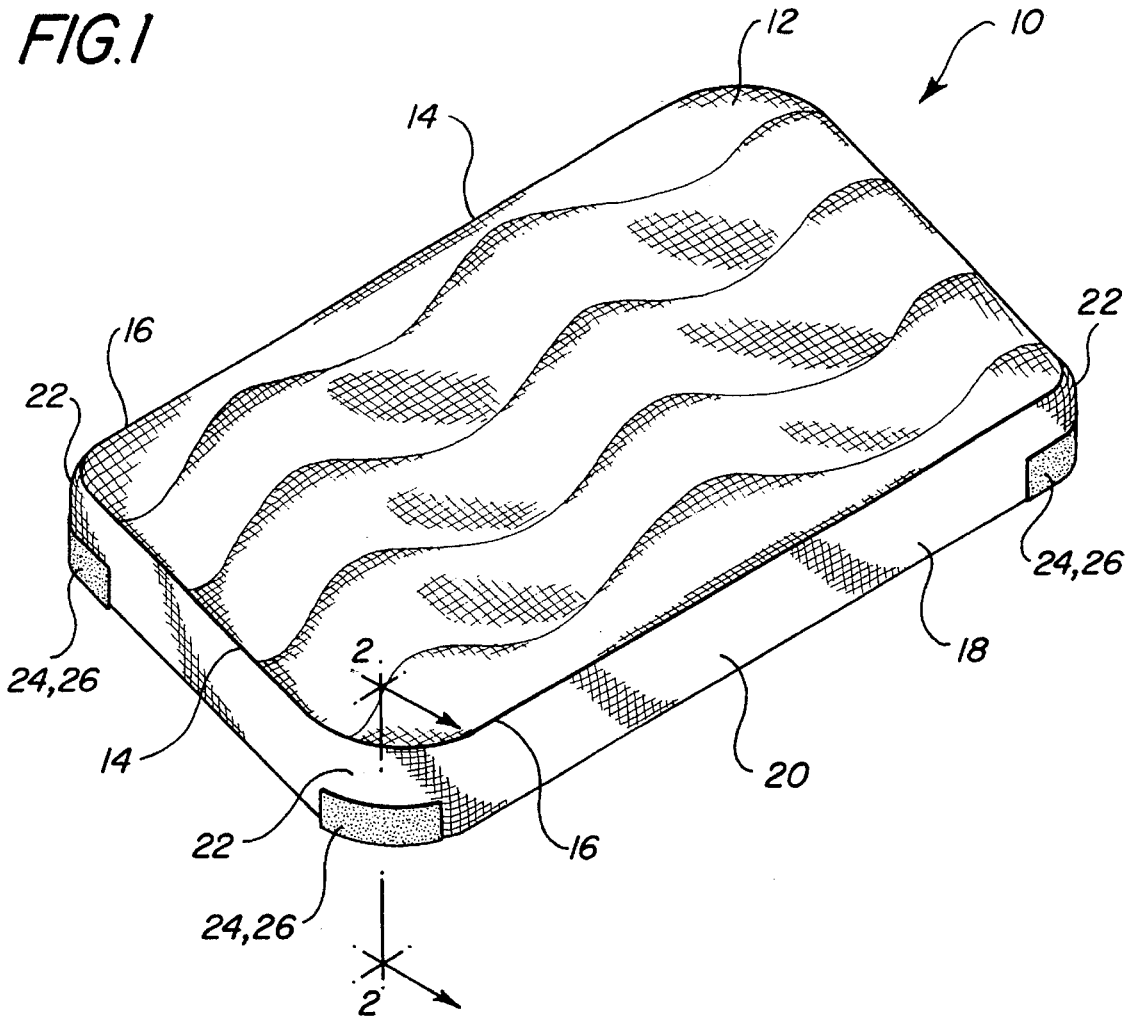
FIG. 1 is a perspective top view of one embodiment of a mattress pad of the present invention.

As shown in FIG. 1, mattress pad 10 comprises a top portion 12 with peripheral edges 14 and corners 16. The top portion 12 is preferably made of a quilted or waterproof material and is intended to cover the top surface of a mattress. Skirt portion 18 consists of straight zones 20 depending from the peripheral edges 14 of the top portion 12 and fitted zones 22 depending from the comers 16 of the top portion 12. The fitted zones 22 are provided with frictional means 24 at least on a portion of their mattress-facing surfaces for holding the mattress pad 10 securely on a mattress. Frictional means 24 may also be provided at other locations on the skirt portion 18.

Figure 2A:
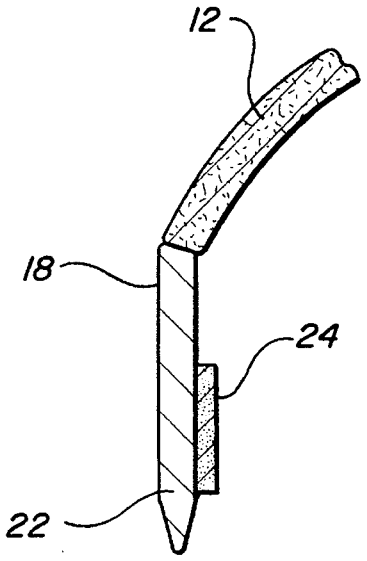
FIG. 2A is a cross-sectional view through line 2—2 in one embodiment represented by FIG. 1.
Figure 2B:
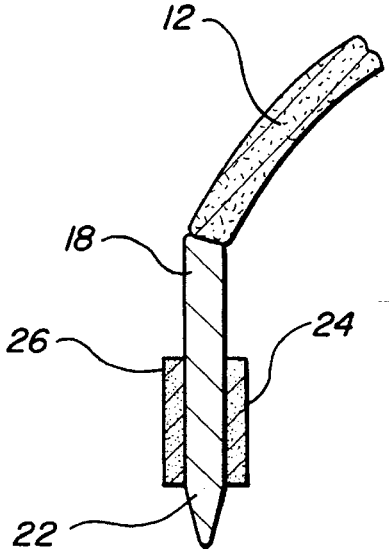
FIG. 2B is a cross-sectional view through line 2—2 in a second embodiment represented by FIG. 1.

FIGS. 2A and 2B are cross-sectional views through line 2—2 of two variations of the embodiment of mattress pad 10 shown in FIG. 1. FIG. 2A shows top portion 12 attached to a fitted zone 22 of skirt portion 18 which has inner frictional means 24 on its inner mattress-facing surface. This variation of mattress pad 10 remains securely fitted onto a mattress, even a mattress with a smooth, satiny covering.

FIG. 2B shows top portion 12 attached to a fitted zone 22 of skirt portion 18 which has inner frictional means 24 on its inner mattress-facing surface and outer frictional means 26 on its outer surface. This variation of mattress pad 10 remains securely fitted onto a mattress and also holds a bottom sheet securely fitted over the mattress pad 10 and onto the mattress.

Inner frictional means 24 may comprise any material which may be applied to or attached to skirt portion 18 of mattress pad 10 and which provides sufficient friction against the mattress to prevent the skirt portion 18 from sliding over the surface of the mattress. Outer frictional means 26 may comprise any material which may be applied to or attached to the skirt portion of mattress pad 10 and which provides sufficient friction against an overlying bottom sheet to prevent relative movement between the sheet and the skirt portion 18. Inner frictional means 24 and outer frictional means 26 may comprise the same or different materials.

In one embodiment of the invention, inner frictional means 24 and outer frictional means 26 were provided by sewing patches of Jiffy Grip™ onto the inner mattress-facing and the outer surfaces, respectively, of the fitted zones of a skin portion of a mattress pad. Jiffy Grip™ is a flannel-like fabric with multiple small discrete vinyl dots on one surface, and it is manufactured by the Staple Sewing Aids Corporation, 141 Lanza Avenue, Garfield, N.J. 07026.

While preferred embodiments of the invention have been shown and described above, it will be apparent to those who are skilled in this art that various modifications may be made to these embodiments without departing from the spirit of the invention. For this reason, the scope of the invention is set forth in the following claims:

I claim:

1. A mattress pad for fitting over a mattress, the mattress pad comprising:

a flat portion with peripheral edges and corners;

a skirt portion depending from the peripheral edges and corners, the skirt portion having straight zones depending from the peripheral edges, fitted zones depending from the corners, a mattress-facing surface, and an outwardly-facing surface;

inner frictional means being provided on the mattress-facing surface of at least a part of the skirt portion, the inner frictional means providing sufficient friction against the mattress to prevent sliding between the mattress and the inner frictional means;

and outer frictional means provided on the outwardly-facing surface of at least a part of the skirt portion, the outer frictional means providing sufficient friction against the overlying fitted sheet to prevent sliding between the outer frictional means and the overlying fitted, sheet, wherein at least one of said inner and outer frictional means are a multiplicity of discrete spots of vinyl.

2. A mattress pad according to claim 1, in which both said inner and outer frictional means are a multiplicity of discrete spots of vinyl.

3. A mattress pad for fitting over a mattress, the mattress pad comprising:

a flat portion with peripheral edges and corners;

a skirt portion depending from the peripheral edges and corners, the skirt portion having straight zones depending from the peripheral edges, fitted zones depending from the corners, a mattress-facing surface, and an outwardly-facing surface;

inner frictional means being provided on the mattress-facing surface of at least one of the fitted zones of the skirt portion the inner frictional means providing sufficient friction against the mattress to prevent sliding between the inner frictional means and the mattress;

and outer frictional means provided on the outwardly-facing surface of at least one of fitted zones of the skirt portion, the outer frictional means providing sufficient friction against an overlying fitted sheet to prevent sliding between the outer frictional means and the overlying fitted sheet, wherein at least one of said inner and outer frictional means are a multiplicity of discrete spots of vinyl.

4. A mattress pad according to claim 3, in which both said inner and over frictional means are a multiplicity of discrete spots of vinyl.

* * * * *